US009901225B1

(12) United States Patent
Haralovich

(10) Patent No.: US 9,901,225 B1
(45) Date of Patent: Feb. 27, 2018

(54) SUPPORT STRUCTURE FOR YOUNG CHILD WASTE ELIMINATION

(71) Applicant: Jennifer Victoria Haralovich, Bloomington, IN (US)

(72) Inventor: Jennifer Victoria Haralovich, Bloomington, IN (US)

(73) Assignee: Bloom A Boo, Bloomington, IN (US)

( * ) Notice: Subject to any disclaimer, the term of this patent is extended or adjusted under 35 U.S.C. 154(b) by 243 days.

(21) Appl. No.: 14/880,222

(22) Filed: Oct. 10, 2015

Related U.S. Application Data

(60) Provisional application No. 62/065,638, filed on Oct. 18, 2014.

(51) Int. Cl.
*A47K 17/02* (2006.01)
*A47K 13/06* (2006.01)

(52) U.S. Cl.
CPC ..... *A47K 17/02* (2013.01); *A47K 13/06* (2013.01)

(58) Field of Classification Search
CPC ..... A47K 17/02; A47K 13/06
USPC ..... 4/254
See application file for complete search history.

(56) References Cited

U.S. PATENT DOCUMENTS 2,517,755 A * 8/1950 Yumoto ..... A47K 13/06 4/234
2014/0013496 A1* 1/2014 Blair ..... A47K 17/02 4/239
2016/0022100 A1* 1/2016 Khaytman ..... A47K 17/02 4/254

* cited by examiner

*Primary Examiner* — Tuan N Nguyen

(57) ABSTRACT

A support structure may provide stability to a young child, infant, and/or neonate during waste elimination. The support structure may include a headrest, backrest, one or more armrests, and may couple to a toilet. The coupling may be implemented by a fastener to secure the support structure to the toilet. In some cases, the support structure may further couple to a potty ring and/or other assistance device for child waste elimination. Additionally or alternatively, the support structure may integrate other assistance devices for child waste elimination in a single support unit.

19 Claims, 8 Drawing Sheets

SUPPORT STRUCTURE FOR YOUNG CHILD WASTE ELIMINATION

PRIORITY CLAIM

This application claims priority to U.S. Provisional application No. 62/065,638, filed 18 Oct. 2014, titled Support Structure for Young Child Waste Elimination, which is entirely incorporated by reference.

TECHNICAL FIELD

This disclosure relates to a support structure for young children during waste elimination.

BACKGROUND

Toilet training is an important portion of child development. In some cases, toilet training may be delayed until children have the motor skills to support themselves while sitting on a toilet. Further, parents may also delay training until language skills develop. In some cases, a child's ability to undergo toilet training may exceed the language or ability of the child to sit upright. Devices to aid parents in language or physical support may allow for advancement of toilet training.

DETAILED DESCRIPTION

In some cases, young children, including infants, babies, and toddler-age children may be capable of toilet training. The capability to toilet train may mature more quickly than the child's ability to perform some tasks of physical coordination. For example, an infant or baby may be otherwise prepared for initial toilet training but may be unable to hold themselves upright to perform waste elimination on an adult or child toilet.

The support structure and waste elimination processes discussed below provide the physical support for a young child during waste elimination. A young child waste elimination support (YCWES) may include a support for young children sitting on an adult-sized toilet to eliminate.

The YCWES may include a back support structure that couples to toilet along with a 'potty ring' or 'seat reducer,' which allows the child to sit in the center of the toilet while eliminating. The YCWES may be placed behind the child between their back and the lid of the open toilet, so that the child does not have to balance in the center of the toilet. The YCWES may also include side panels. The YCWES side panels may surround the arms, shoulders and torso of small children, for example children below 70-90 cm in height, and keep them in the center of the toilet on the potty ring or seat reducer. Additionally or alternatively, the side panels may fit under the arms of larger children, for example above 70-90 cm in height, supporting their torsos and keeping them in the center of the toilet on the potty ring or seat reducer.

In various implementations, the YCWES may provide balance and comfort to the young child, such as an infant, while performing waste elimination. Thus, the child may be properly trained for waste elimination on a toilet. Further, the additional comfort may reduce resistance by the child to the training process.

Figure 1:
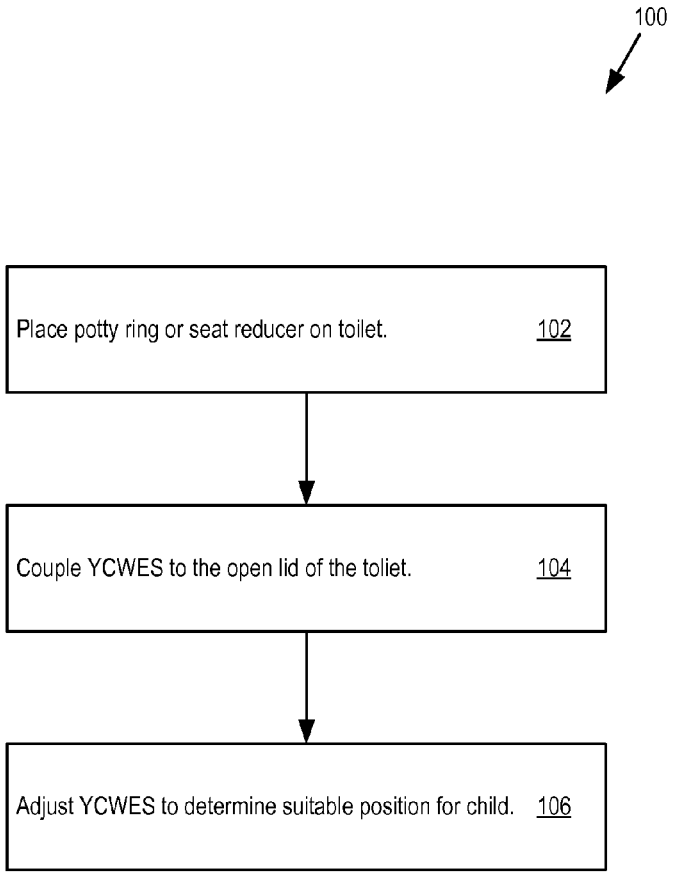
FIG. 1 shows an example process for fitting a young child waste elimination support (YCWES) to a child.

FIG. 1 shows an example process 100 for fitting a YCWES to a child. Place a potty ring or seat reducer securely on the seat of the toilet (102). In some cases the potty ring or seat reducer may have fastening members to couple to the toilet seat. These fastening members may be engaged for added security. In some cases a properly coupled potty ring or seat reducer may resist some degree of shifting. Couple the YCWES to the open lid of the toilet (104). In some implementations, the YCWES may include fastening member that may hold the YCWES in place on the toilet seat above the potty ring or seat reducer via friction between a surface of the fastening member and the surface of the toilet. For example, the YCWES may include an elastic fastener strap that may be extending around the toilet tank. In some implementations, the elastic strap may include a buckle, such that coarse tightening may be achieved by adjusting the length of the strap using the buckle. The elasticity of the strap may provide fine-tuned gripping of the toilet surface. Additionally or alternatively, the YCWES may include clips for coupling to the toilet seat. In some implementations, the YCWES may include backing to fill the space between the child's back and the open lid of the toilet seat. In some cases, the size and positioning of the YCWES may allow for use of the YCWES without fastening members for coupling to the toilet seat.

In an example implementation, including an elastic strap fastener, the YCWES may be positioned against the open toilet lid, with the arms facing out toward the bowl of the toilet, and the bottom of the back of the YCWES touching the uppermost front face of the open toilet lid. The elastic connecting strap should be above the uppermost edge. For example, about 4 cm above the edge. The elastic strap may then be pulled toward the tank of the toilet, positioning it down around the left and right sides of the open toilet lid as you move the YCWES down toward the toilet bowl. The example YCWES may be coupled to the toilet seat when the support's base and the bottoms of its side panels touch the top surface of the potty seat or seat reducer, and its back is flush with the outward facing surface of the open toilet lid. The connecting strap may be adjusted to securely fasten the YCWES to the toilet lid such that the YCWES remains in place even if jostled.

The YCWES may be adjusted to determine a suitable position for the child (106). The user may assess the child's head and neck control. In some implementations, a head rest providing comfort but not head support may be used. Additionally or alternatively an adjustable headrest designed to support infants or other children unable to support their own heads may be included with the YCWES. The headrest may be adjusted to hold the child's head in place. In some implementations, the user may choose between the 'arms in' or 'arms out' seat positioning. For example, the height of the child may be used in determining the positioning of the child's arms in relation to the side panels.

The child may be placed securely in the center of the potty ring or seat reducer. The lower back of the child may be adjusted to align with the back edge of the potty ring or seat reducer hole. The child's upper back and lower back may be positioned such that they touch the back support of the YCWES at a position under the backward-angled head support.

In various implementations, the position of the top of the side panels of the YCWES in relation to the child's armpits may be used to determine the position for the child's arms. Thus, the YCWES may include internal sizing guides. If the child's armpits fall below the top edge of the YCWES's arms, then the child may sit with their arms in the interior of the YCWES, touching the sides of their torso. If the child's armpits are above the top edge of the arms of the YCWES, then the child's arms may be positioned over the side panels of the YCWES, allowing the child to rest outside of the YCWES as the child's bottom and torso remain inside. Suitable positioning may allow the child to be stable and comfortable.

In some implementations, the child can choose to let their head tilt back onto the headrest or maintain an upright position in alignment with their upper and lower back. Additionally or alternatively, the YCWES may provide head support for children with limited neck strength. For example, straps or cushions may be place on the headrest to aid children too young to maintain neck support. In some cases, these straps or cushions may be implemented as an add-on module that may couple to the headrest to add support for low neck strength children.

Figure 2:
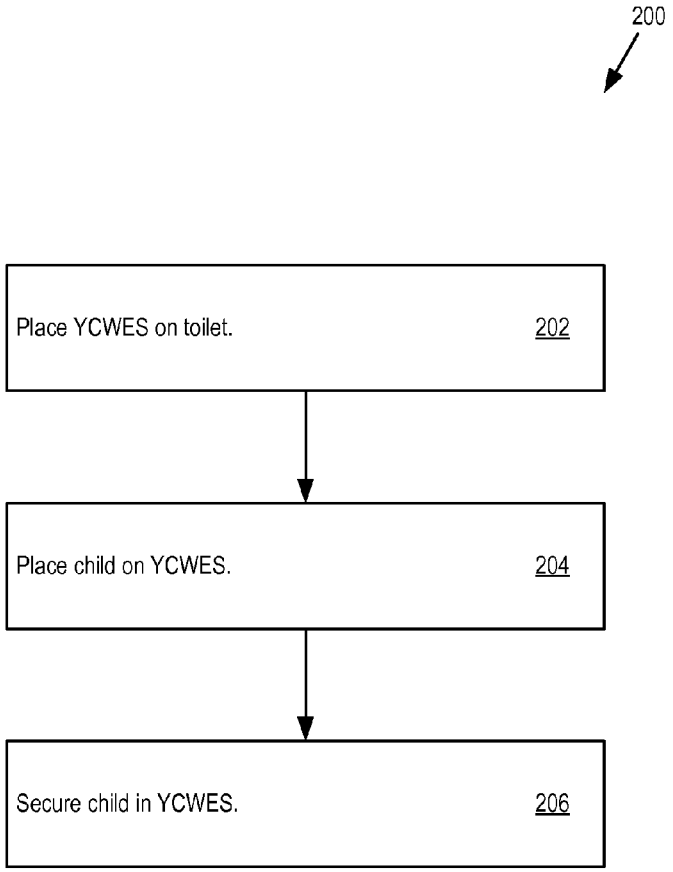
FIG. 2 shows an example process for waste elimination using the YCWES.

FIG. 2 shows an example process 200 for waste elimination using the YCWES. Couple the YCWES to the toilet (202). For example, the coupling may be accomplished using the positioning process 100 discussed above. In various implementations, the YCWES may be coupled to the toilet just prior to use by the child or placed in advance of the occasion of use by the child. In various implementations, the YCWES back support may be placed on the toilet seat either before or after the potty ring or seat reducer. In some cases, when the potty ring/seat reducer is secured in the toilet bowl first, the YCWES may slide down into position secondarily. The lowermost surfaces of the YCWEs may make contact with the potty ring/seat reducer's uppermost surface. If the YCWES is secured first, the user of the YCWES may leave a gap beneath to allow the potty ring/seat reducer to slip in between the YCWES and the toilet seat.

In some cases, a toilet seat may include a permanently or semi-permanently installed seat reducer that is designed to function as a portion of the installed toilet seat. This type of seat reducer fits within the toilet seat lid when not in use, and is pivoted down from the lid to allow the child to sit on it. For such seat reducers, the seat reducer may be positioned before the YCWES is installed to avoid interfering with the motion of the seat reducer while it is positioned. The YCWES may be used for virtually any elimination occasion the child may have.

Place your child on the in the YCWES (204). Secure child in YCWES (206). This may be accomplished by placing the child's bottom securely on the potty ring or seat reducer. In various implementations, the child may be positioned for comfort and security when the child's lower back aligns with the back edge of the potty ring or seat reducer hole. Both the child's upper and lower back may make contact by touching the back support of the YCWES for comfort and security.

In various implementations, the YCWES may work in conjunction with support from the caregiver supervising the child. For example, the caregiver may place the child in a seated position, with the child's head up or tilted slightly back on the headrest, back flat against the center of the back support, legs forward and arms in front or to their sides. For example, in the case of very young children who have head and neck control but who may lack core muscle strength, their caregiver may place one hand on either side of the child, generally around the ribcage, under the arms, to support their torso and keep the child in place. However, in some implementations, additional arms from the YCWES may provide the some or all of the support supplied to the child while using the YCWES. For children with more abdominal control, a caregiver may help restrain the child in a seated position. In some cases, lap belts or other restraints may provide this security.

The YCWES may include a central front panel. The front panel measures 22.86 cm wide and is 19.05 mm thick. The height of the front panel can be made to fit the child or children using the apparatus, varying from 27.94 cm to 38.1 cm. The front panel comes in contact with the child's lower back, upper back and, in the case of small children, head. Its lowermost surface comes in contact with the seat reducer or toilet ring that is being used in tandem with the YCWES. The front panel's left and right sides come in contact with the arms of the YCWES. The front panel's surface facing the tank of the toilet helps create the negative space between the child and the open lid of the toilet. An adjustable headpiece can be attached to the front panel to provide comfort and stability for children.

The second two parts of the YCWES are the arms. The arms attach to the YCWES in two places, once to a side of the front panel and once to a side of the rear panel. The arms measure a total of 25.4 cm in length, 6.35 cm in height and 19.05 mm in thickness. The arms connect to the front panel 16.51 cm back from the surface furthest from the rear of the YCWES, creating forward and back sections of the arms. The arms connect to the rear panel where they terminate, closest to the open lid of the toilet. The inner surface of the forward arms of the YCWES may come in contact with the child's outer arms or ribs and torso, depending on the size of the child, thus providing stability as the child sits to eliminate. The topmost surface of the forward arms may touch the underside of a taller child's arms. The outside facing surface of the forward arms may touch the child's inner arms. The bottommost surface of the forward arms may touch the top of the child's upper leg. The back inner surface helps create the negative space between the child and the open lid of the toilet.

The rear panel bridges the gap between the two back arm sections. It comes in contact with the lid of the open toilet. Its lowermost surface may also touch lower parts of the toilet lid, such as hinges, bolts or protrusions, or some surface of the toilet bowl itself that is near the open toilet lid. The inner surface of the rear panel helps create the negative space between the child and the open lid of the toilet.

The YCWES's stability strap may connect the apparatus to the inside surface of the open lid of a toilet. Additionally or alternatively, the stability strap may couple to other portions of the toilet and/or a potty ring. The stability strap can connect in many different ways, including but not limited, to rivets, glue, staples, snaps buckles, and/or other fastening devices. In some case the stability strap may be attached internally, via a slit or hole. The stability strap can include a device which allows it to be adjustable to the circumference of the lower part of the toilet lid, such as a buckle or clips. The strap may couple to the lower part of the toilet lid, below the widest part of the lid, to provide a secure hold. The strap may flex down and over the widest part of the lid in order to reach the coupled position with the toilet seat. The strap itself may have the strength to withstand jostling that might occur while a child is using the YCWES. In some cases, stability strap may be 2 cm width or greater and made of an elastic material. However, thinner straps may be used with stronger materials. For example woven metal or carbon fiber bands may allow for thinner straps. Additionally or alternatively, other reinforced designs may be used.

In some cases, it may be advantageous to use light and strong materials to form portions the YCWES. For example, some stability strap configurations may work best for YCWES devices weighing less than 5 pounds. Additionally or alternately, other attachment configurations may be used such as hooks, clasps, ratchets, clips, seatbelt buckles, or other attachment configurations or combinations.

In some implementations, the YCWES may be formed from a solid frame with a soft cover for comfort. In some implementations, the YCWES may be formed from a uniform block of material such as, foam, rubber, plastic or other material. Some example materials may include: vitreous china; wood (maple or birch mixed with resin) plastic (zinc stearate) blend; plastic (polystyrene); acrylic resin; hardwood, including oak and bamboo; polypropylene; polyresin; vinyl (possibly antimicrobial) and foam to provide soft cushioning on the exterior, if core material is stiff; and/or other material. In some cases, metals such as aluminum or steel may form a frame. In some cases, accents such as rivets, buckles, clasps, or other accents may be included in the YCWES to increase the aesthetic appeal of the device. In some cases, the YCWES device may be 3D-printed from one or more materials. For example, a plastic core structure may be 3D-printed and a cloth outer cover may be 3D-printed onto the plastic core structure. Additionally or alternatively, the plastic core may be printed at varying densities from the inner core to the outer core such that a sturdy inner core is covered by a porous cushioned outer core layer, which in turn may be covered by a thin waterproof sealing layer.

In some implementations, a cloth slip-cover may be used to cover the apparatus to provide allow for ease in cleaning the device. The cloth slip cover may be made from soft water proof materials such as nylon, cotton, polyester, rayon, and/or other natural or synthetic cloths. The cloth may be machine washable/dryable for low complexity removal washing and placement back on to the YCWES. In various implementations, the safety strap may couple to the slip-cover. Additionally or alternatively, the strap may be machine washable/dryable.

Example Implementation 1

Figure 3:
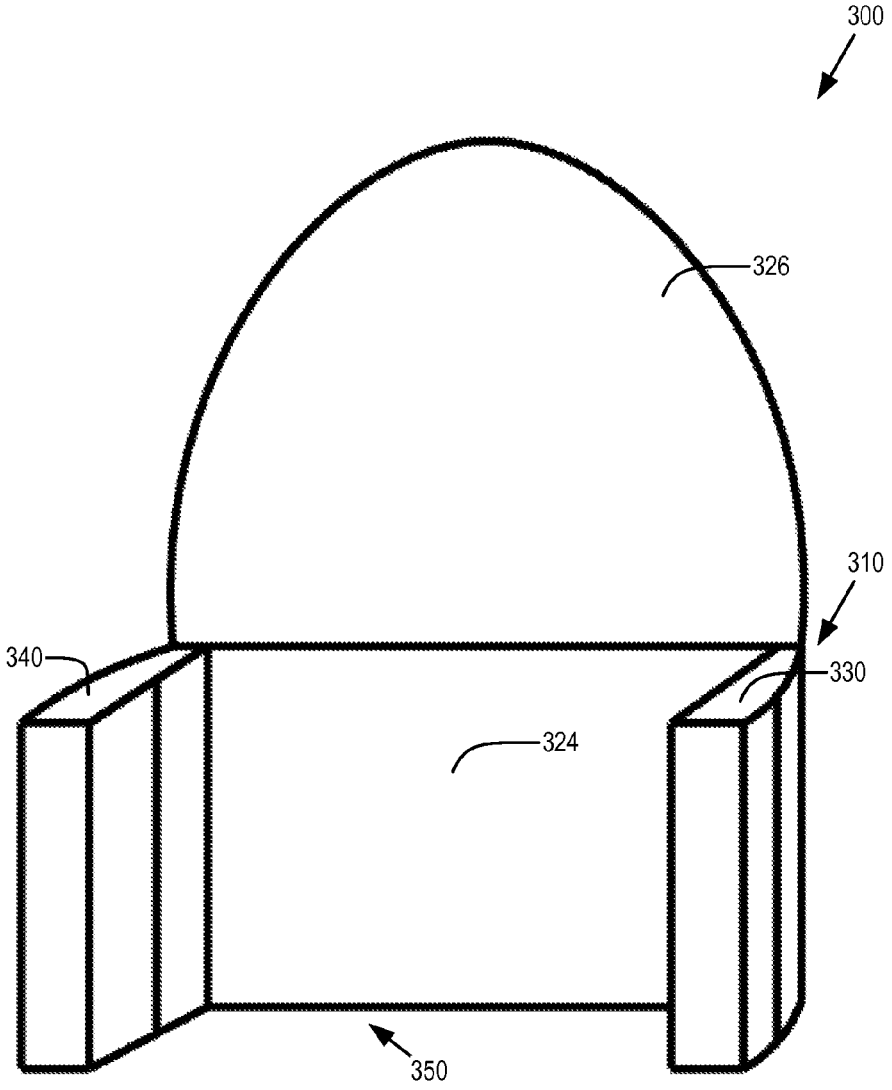
FIG. 3 shows an example YCWES.

FIG. 3 shows an example YCWES 300. The example YCWES includes a base 310, side panels 330, 340, bottom panel 350, and securing strap.

In an example YCWES 300, the base 310 may be used to fill the gap between the child and the toilet lid. The front panel, may be proximate to side panels 330, 340 of the YCWES, and may include two sections, a backrest 324 and a headrest 326. In the example YCWES, the backrest panel is 19.5 cm height and 23 cm wide. However, other sizes may be used to support different child size models and/or panel configurations. The backrest panel 324 may bridge the space between the two side panels 330, 340. In various implementations, the backrest 324 may directly support the child's lower back and mid to upper back depending on the size of the child. In the example shown, the backrest 324 is vertically aligned and a flat panel. However, contoured backrests may be implemented. The backrest may intersect with the side panels 330, 340 at right or near right angles. The top edge of the backrest 324 may meet with the headrest 326 at about a 35 degree angle.

The headrest panel 326 may be around 24 cm in height and taper in a tall arc. The headrest 326 may be about 28 cm at its base where it connects to the backrest 324 and side panels 330, 340. At the top of the YCWES 300, the headrest 326 may be 15 cm wide. The headrest 326 may support the head of a small child when reclining and/or support the upper back and head of a larger child when reclining. Children can choose to use this support to rest their heads as they eliminate. Alternatively, children may hold their heads up straight on their own. The shoulders of older children will touch at least the bottom portion of the head rest. In some implementations, the headrest 326 may be tall enough to clear the toilet bowl lid. The height of the headrest 326 may prevent a child's head from coming into contact with the toilet bowl lid. The headrest 326 may be attached to the two top side panels and the uppermost panel to give the seat base its depth.

The two base side panels 330, 340 may include the bottom rectangles and the connecting curved panels. The bottom rectangles may be located on either side of the apparatus between the back edge of the outer face of the side panel 330, 340 and the rear panel, which touches the toilet lid. The bottom rectangles may be 19 cm in height to match the backrest panel 324 and side panel 330, 340. The bottom rectangles may be 11.5 cm wide. The bottom rectangles panel may to connect the arms to the rear panel at a 15 degree angle inward toward the rear panel. The rear panel may have less surface area than the front-facing panels of the base. The rear panel may provide cushioning to the child's lower back, which may be in contact with the touching the backrest 324 during use. The rear panel may rest against the toilet lid during use. The securing strap 370 may be attached to the bottom panels.

The connecting curved side panels may bridge the gap between the outer edges of the headrest 326 and the rear panel. The connecting curved side panels intersect at the uppermost panel. The curved side panels taper upward from the top edges of the base side panels. The curved side panels measure 12.7 cm wide at the bottom and 6.35 cm at the top. The inward and upward curve of these panels measures 25.4 cm in height.

The uppermost panel connects with the two curved side panels; the headrest 326; and the rear panel. The uppermost panel forms the top curve of the arc-shaped portion of the base, and measures 15.2 cm from side to side and 6.35 cm front to back.

The rear panel encloses the space between the base's lower rectangle panels. The rear panel connects to the curved side panels, the uppermost panel, and the bottom panel of the apparatus. During use, the rear panel may be in direct contact with the toilet seat lid. The rear panel may be designed to fit the flat lid surface of a round toilet, and/or the elongated, lipped lid surface of an oblong toilet. The rear panel is 40.6 cm in height and measures 22.9 cm at its base. The rear panel tapers to an arc with a width of 6" at the top. The arc of the rear panel is matched to that of the headrest 326 panel. In some cases, a large contact area between the rear panel and the toilet lid may provide for increased stability. Additionally or alternatively, clips, straps or other fastening members may be used to ensure that the relative motion between the toilet seat and the rear panel is minimized.

The arms protrude from the lower, front section of its base. The arms include of four faces. The bottom panel closes the arm structure's base.

The inner faces of the arms touch the backrest panel 324 of the base. The inner faces measure 19 cm in height and 11.4 cm wide. The top edge connects with the arm's top face, the bottom edge connects with the bottom panel, and the outward most edge connects with the front face of the arm.

The outer faces of the arms are parallel to the inner faces, the outer faces of the arms connect to rear edge of the bottom panels. The outer faces measure 19 cm in height and 11.4 cm wide. The top edge connects with the arm's top face, the bottom edge connects with the bottom panel, and the outward most edge connects with the front face of the arm.

The front faces of the YCWES's arms form the outermost faces of the apparatus. The front faces are the farthest surfaces from the rear panel. The front faces measure 19 cm in height and 2.5 cm in width. The front faces connect with the arm's top face, inner face, outer face, and the bottom panel. The top and side edges of the front face may be rounded to provide a safe surface for the child.

The uppermost faces may be match in width of the inner and outer faces. In this case, the uppermost faces are 11.4 cm long and 2.54 cm wide. The edges of the uppermost faces connect with the inner, outer and front faces. The uppermost faces may be curved to provide a safe surface for the child.

For children that do not position their arms about the arms of the YCWES, the arms and backrest of the YCWES may provide the children with three-sided support. In this three-sided support configuration the YCWES supports the children's backs, torsos and arms.

The bottom panel may cover any open volumes within the YCWES by coupling to the lower edges of the rear panel, the side rectangle panels, the back rest panel, and the arms' inner, outer and front facing panels. The bottom panel may close the apparatus into one unified piece and stop unwanted materials from entering the hollow areas of the YCWES. The bottom panel may also be shaped to couple with a potty ring or toilet seat to provide stability during use.

In the example implementation, the stability strap may include an elastic band that connects to the outward facing back sections of the arms, 1-2 cm from the top and bottom edges, set in 3-4 cm from the edges of the arms nearest to the open toilet lid.

In some implementations, the example YCWES 300 may be fused to a potty ring to form a single unit to couple to a toilet seat.

Example Implementation 2

Figure 4:
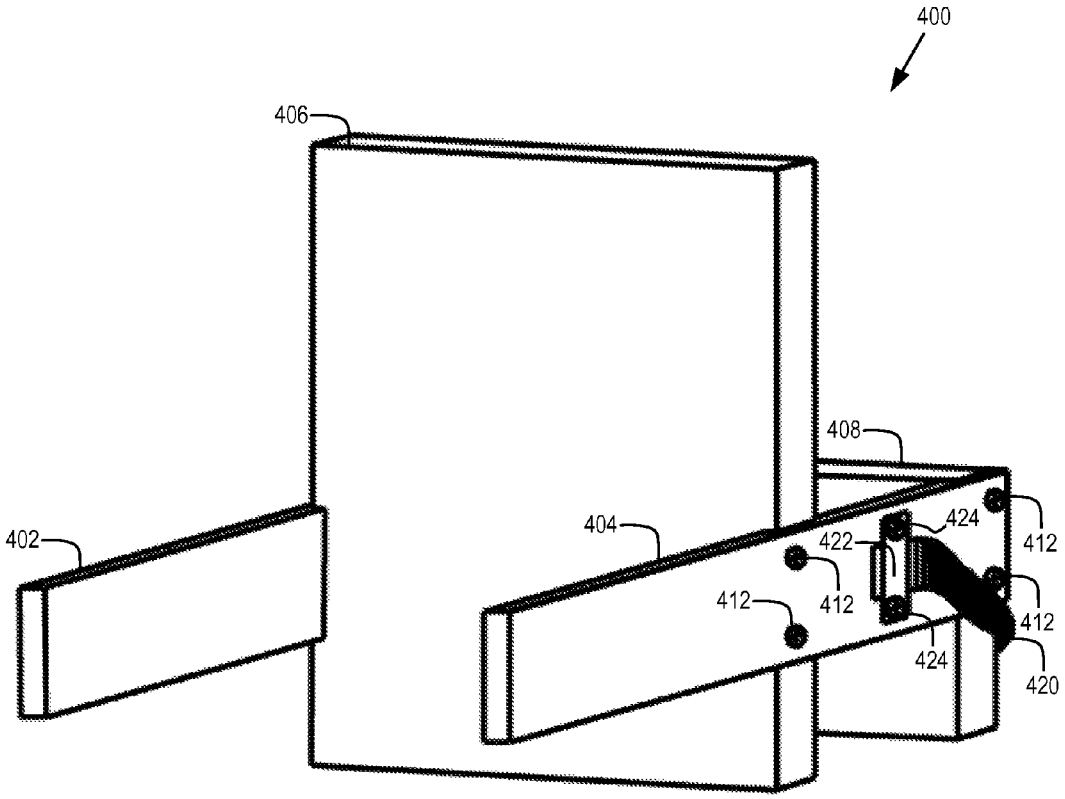
FIG. 4 shows another example YCWES.

Referring now to FIG. 4, another example YCWES 400 is shown. The YCWES 400 may be constructed from panels 402, 404, 406, 408 such as wooden boards, plastic panels, molded plastic, or other materials (e.g., those discussed above).

The panels 402, 404, 406, 408 may be joined using fasteners 412. The fasteners may include screws, bolts, staples, formed male/female connecters, or other fasteners. Additionally or alternatively, the panels 402, 404, 406, 408 may be joined by gluing or fusing. Virtually any means of affixing the panels to one another may be used.

In the example YCWES 400, an elastic strap 420 may be affixed to the arm panels 402, 404. In the example YCWES 400, the elastic strap 420 is affixed to the arm panels via a mend brace 422 and fasteners 424. The mend brace 422 may be made from various materials such as metal, plastic, or other material suitable for holding the elastic strap 420 in place. The fasteners 424 may be of similar form or structure to fasteners 412. Although not shown, the elastic strap 420 additionally or alternatively may be affixed to front 406 or rear 408 panels. The elastic strap 420 may be affixed to virtually any portion of the YCWES 400 that allows for the elastic strap 420 to hold the YCWES to the toilet.

Figure 5:
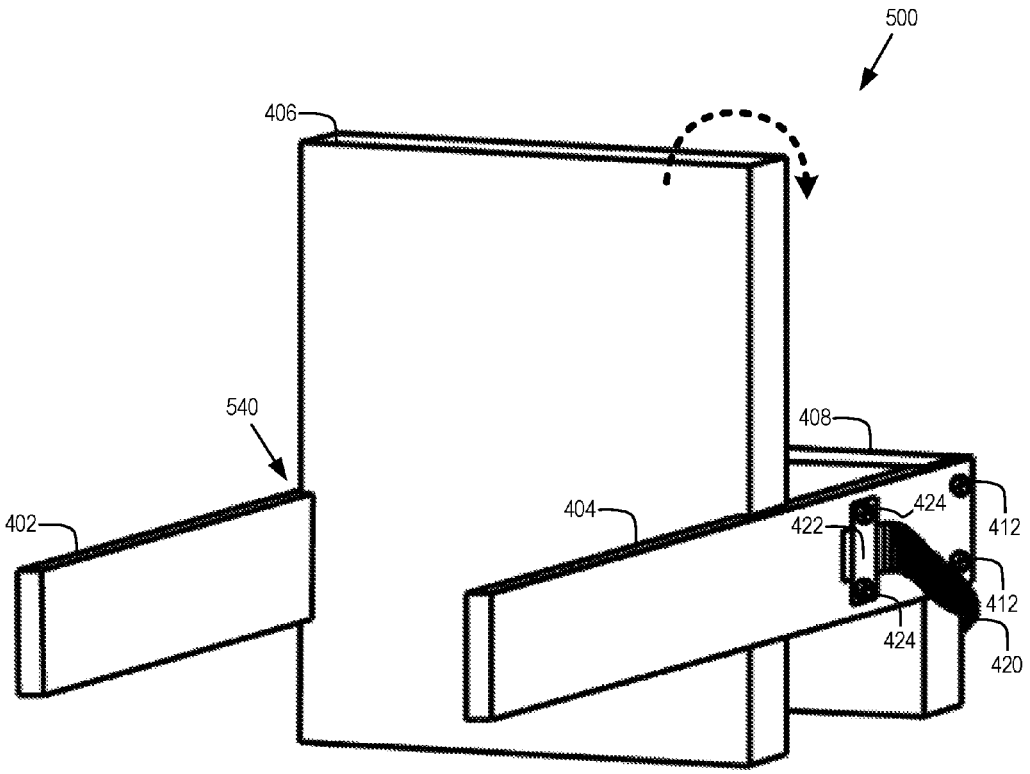
FIG. 5 shows the example YCWES of FIG. 4 with an adjustable reline level.

Front panel 406 may form the back and headrest of the YCWES 400. The front panel 406 may be sized such that an infant, young child, or neonate may be comfortably placed in front of the YCWES and receive head and/or neck support. In the example shown, the front panel 406 is oriented at 90 degrees (e.g., normal) to the top surfaces of the arms panels 402, 404. However other relative orientations may be used. For example, the front panel 406 may be oriented at a slight (e.g., 90-100 degrees) or significant (e.g., 100-179 degrees) recline. In some cases, the front panel may be fixed to the arms using a hinge mechanism such that the recline level may be selected by the caregiver supervising the child that is using the YCWES 400. FIG. 5 shows an example YCWES 500 where the front panel recline level may be adjusted. In some cases, the hinge 540 may allow for continuous settings. In other cases, the hinge 540 may have two or more lockable settings allowing a selection of upright and recline positions. The front panel 406 may be a flat panel or contoured seating panel for back comfort.

Figure 6:
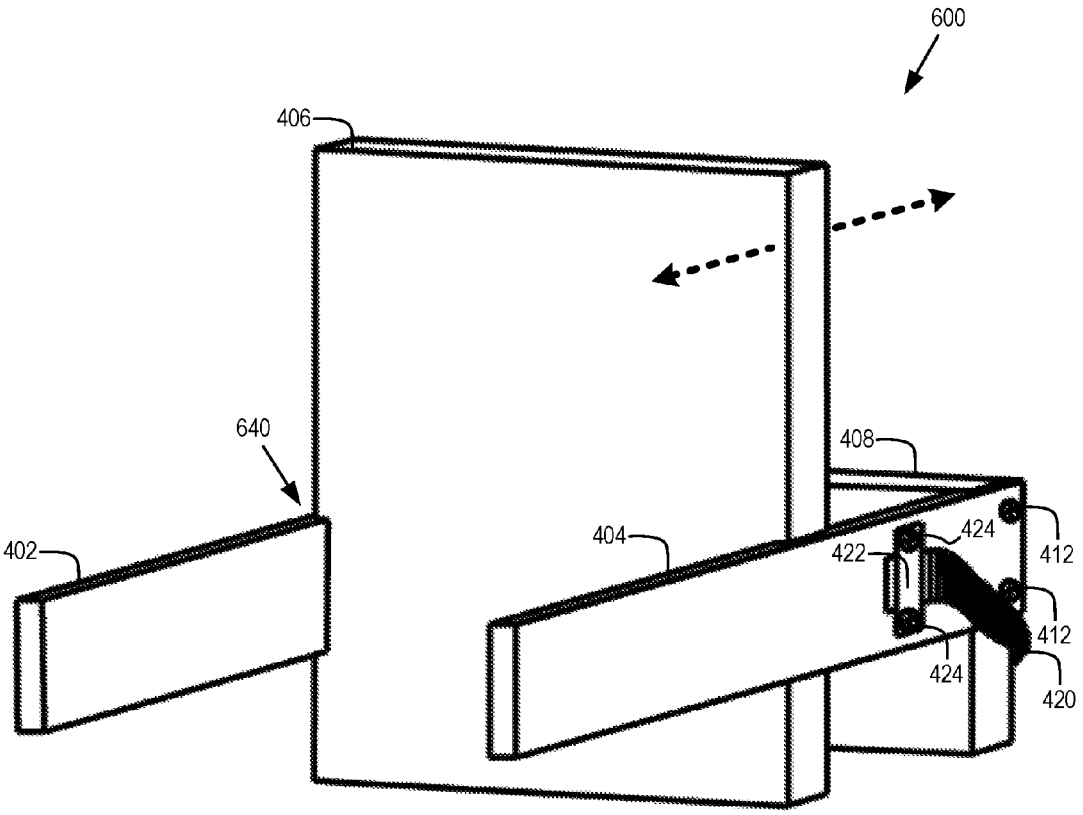
FIG. 6 shows the example YCWES of FIG. 4 with an adjustable front panel to rear panel spacing.

Referring again to FIG. 4, the rear panel 408 may be affixed to the arm panels 402, 404. The rear panel 408 may be spaced from the front panel 406 such that the front panel 406 is in a natural seating position for the child (e.g., relative to the front of the toilet seat) when the rear panel is up against the back of the toilet. In the example YCWES 400, the spacing between the front panel 406 and the rear panel 408 may be fixed. In some implementations, the front panel 406 may be fixed to the arm panels 402, 404 using a slider 640, such that the front panel 406 to rear panel 408 spacing may be adjusted. In some implementations, the slider may allow continuous positioning. In other implementations, the slider may have two or more lockable positions. FIG. 6 shows an example YCWES 600 where the front panel 406 to rear panel 408 spacing may be adjusted. In some implementations the front panel 406 may perform both recline and spacing adjustments.

Referring again to FIG. 4, in some implementations, the rear panel 408 may have weights attached or may be made of a heavy material to prevent the YCWES from tipping forward.

In some cases, a natural seating position for a child may be shifted towards the front of the toilet seat relative to the natural seating position for an adult. This may be because children (e.g., young children, infants, neonates, or other young children) may have shorter legs than adults. In some cases, a natural seating position may allow a child to bend their knees over the front of the toilet seat. Alternatively, a natural seating position for a child may allow the child to have all or most of their upper and lower legs fully on the toilet seat or potty ring.

The arm panels 402, 404 may be spaced apart by the front 406 and rear 408 panels. In some cases, the spacing between the arm panels may be selected such that taller children (e.g., toddlers or other ambulatory children) may rest both arms comfortably on top of the arm panels while younger children (e.g., infants, neonates) are held upright with their arms between the arm panels 402, 404. Thus, the spacing may be selected based on the shoulder widths of taller children. In some implementations, the front portions of the arm panels 402, 404 in front of the front panel 406 may be joined to the rear portions of the arm panels 402, 404 by a hinge. The hinged arm panels may allow for adjust of the spacing of the arm panel portions in front of the front panel 406. Allowing adjustment of this spacing may allow for comfort over a broader range of child sizes compared to non-hinged arm panels.

In some implementations, the spacing between the arm panels may be selected to allow for an YCWES 400 width that may sit securely on a broad range of toilet sizes and configurations.

Figure 7:
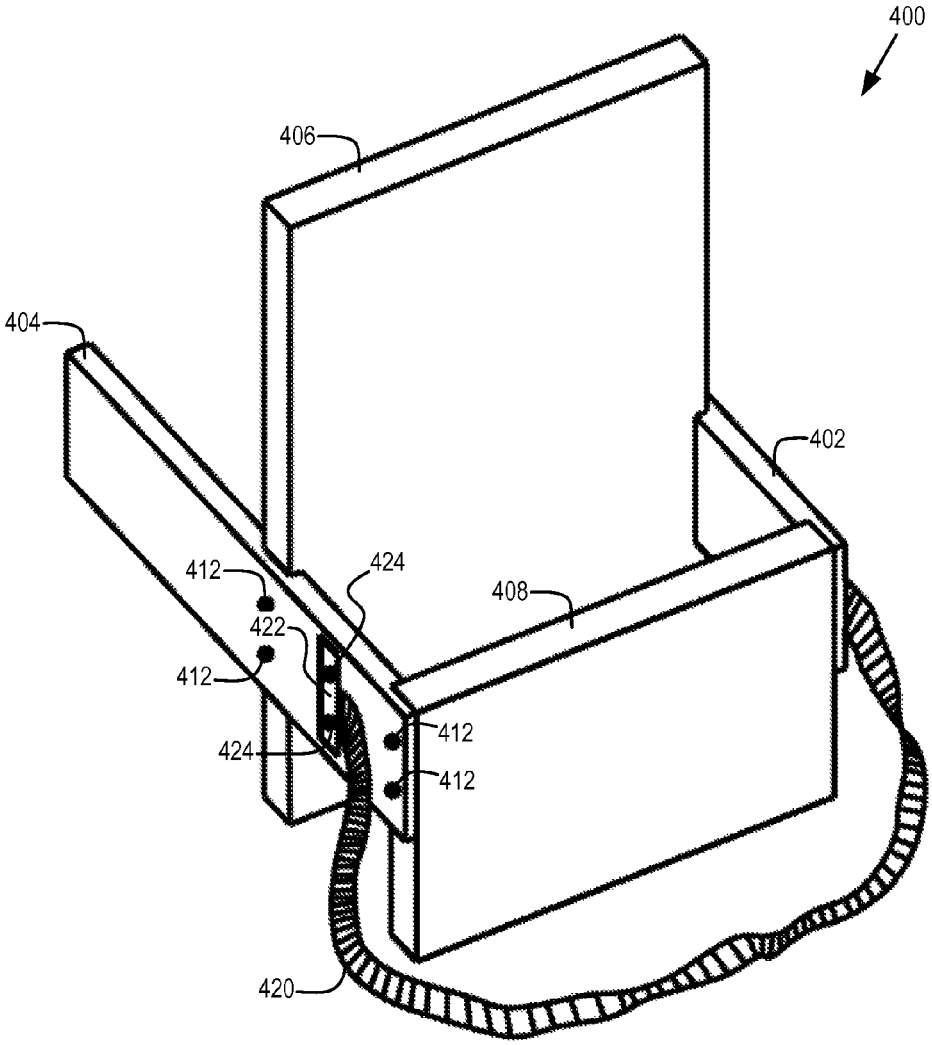
FIG. 7 shows the example YCWES of FIG. 4 from a rear view.

FIG. 7 shows the example YCWES 400 from a rear view.

Figure 8:
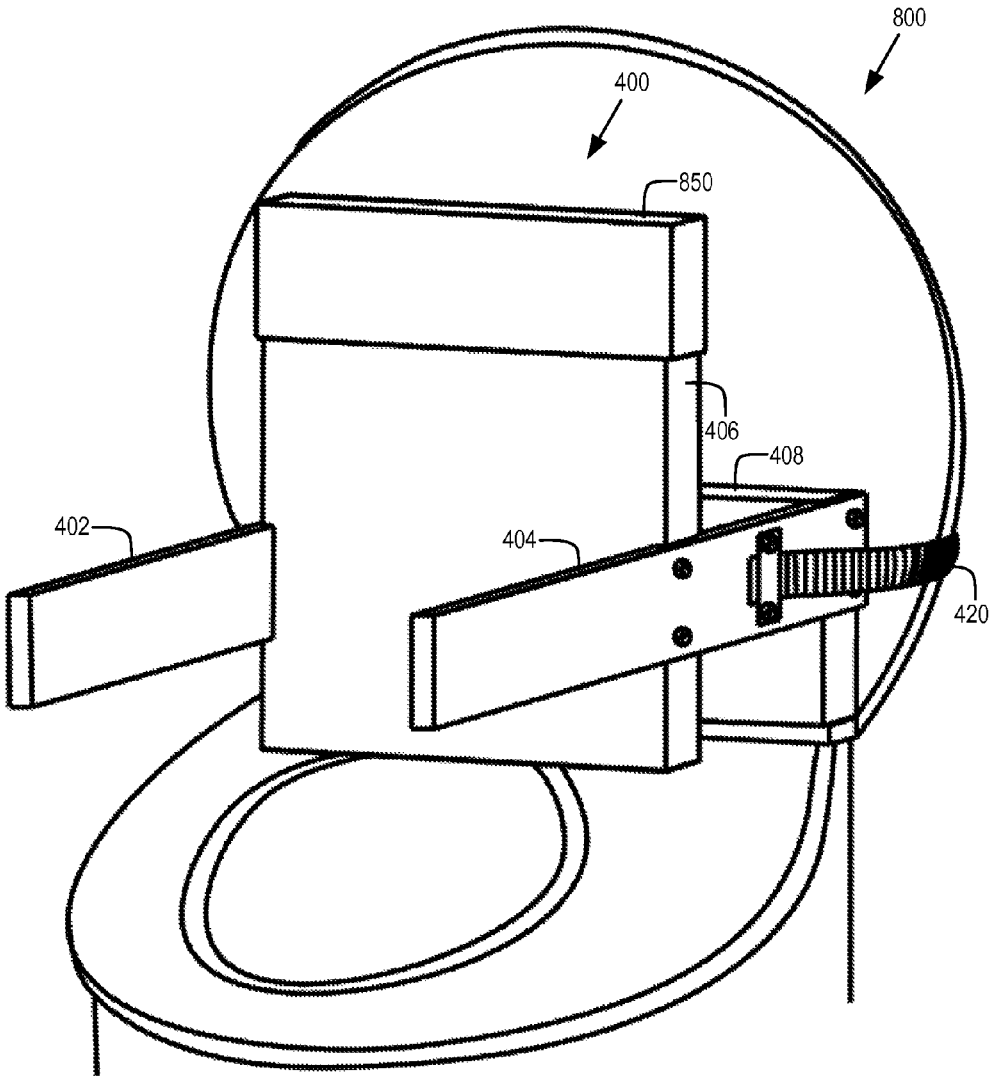
FIG. 8 shows the example YCWES affixed to a toilet seat using an elastic strap.

FIG. 8 shows the example YCWES 400 affixed to a toilet 800 using the elastic strap 420. The YCWES 400 further has a bonnet 850 placed on the top of the front panel 406. The bonnet 850 may be made of a cushioned material for head comfort. For example, the bonnet 850 may be made of natural or synthetic cloth. In some cases, the bonnet 850 may be removable from the front panel for cleaning. For example, the bonnet 850 may be machine washable. The bonnet 850 may cover the top of the front panel 850. Additionally or alternatively, the bonnet 850 may further include a slip cover in addition the head cushion to cover the full front panel and the armrests.

Various implementations have been specifically described. However, many other implementations are also possible.

What is claimed is:

1. A device comprising:

a support structure configured to hold a young child in an upright seated position, when the support structure is coupled to a toilet, the support structure comprising:

a backrest panel configured to prevent the young child from falling backwards out of the upright seated position;

armrest panels, coupled to the backrest panel, the armrest panel configured to prevent the young child from sliding sideways out of the upright seated position; and a rear panel coupled to the armrest panels, the rear panel spaced relative to the backrest panel such that the backrest panel is projected outward from a toilet seat back of the toilet when the rear panel rests against the toilet seat back; and a fastener affixed to the support structure, the fastener comprising a surface configured to engage the toilet in frictional contact to fix a position of the support structure relative to the toilet.

2. The device of claim 1, where the fastener comprises an elastic strap.

3. The device of claim 2, where the elastic strap is affixed to the arm panels.

4. The device of claim 3, where the elastic strap is affixed to the arm panels via a mend brace.

5. The device of claim 1, where the armrest panels are affixed to the backrest at an equal height on opposite sides of the backrest panel.

6. The device of claim 1, where the backrest panel further comprises a headrest configured to provide head support for a child with insufficient neck strength to hold a head upright.

7. The device of claim 1, where support structure further comprises a sliding connecter that couples the backrest panel to the armrest panels, the sliding connecter configured to allow adjustment of a relative spacing between the rear panel and the backrest panel.

8. The device of claim 1, where the fastener comprises a clip, a vice, or both.

9. The device of claim 1, where the support structure further comprises a cloth bonnet covering for the backrest panel.

10. The device of claim 1, where support structure further comprises a hinge that couples the backrest panel to the armrest panels, the hinge configured to allow adjustment of a recline level of the backrest panel.

11. The device of claim 1, where the support structure comprises seat reducer coupled to the backrest, the seat reducer comprising an aperture smaller than an opening of a toilet seat of the toilet.

12. A method comprising:

positioning a support structure over a toilet;

affixing, via a fastening member, the support structure to the toilet;

prior to a child performing waste elimination, placing the child within the support structure such that the support structure holds the child in an upright seated position above the toilet;

adjusting a sliding connector between an armrest panel of the support structure and a backrest panel of the support structure to alter a spacing between the backrest panel and a rear panel of the support structure, the rear panel configured to rest against a toilet seat back of the toilet; and after the child completes performance of the waste elimination, removing the child from the support structure.

13. The method of claim 12, where affixing, via a fastening member, the support structure to the toilet comprises extending an elastic strap around a toilet seat back of the toilet.

14. The method of claim 13, where extending an elastic strap around a toilet seat back of the toilet comprises adjusting a length of the elastic strap.

15. The method of claim 12, further comprising positioning a seat reducer between the support structure and the toilet.

16. The method of claim 12, further comprising adjusting a recline level of a backrest of the support structure.

17. The method of claim 12, further comprising removing a bonnet from a backrest of the support structure for cleaning.

18. A device comprising:

a support structure configured to hold a young child in an upright seated position, when the support structure is affixed to a toilet, the support structure comprising:

a front panel comprising:

a first flat board oriented upright relative to a toilet seat of the toilet; and a removable cushioned bonnet slip cover for the first flat board;

arm panels comprising:

a second flat board affixed to a first side of the first flat board; and a third flat board fixed to a second side of the first flat board such that the second and third boards a fixed parallel and opposite each other at equal heights relative to the toilet seat of the toilet; and a rear panel comprising a fourth flat board affixed between the second and third flat boards, the fourth flat board oriented parallel to the first flat board and spaced relative to the first flat board such that the first flat board is projected outward from a toilet seat back of the toilet when the fourth flat board is held against the toilet seat back of the toilet; and an elastic strap configured to extend around the toilet seat of the toilet to fix a position of the support structure relative to the toilet via frictional contact.

19. The device of claim 2, where the elastic strap further comprises a buckle configured to allow adjustment of a length of the elastic strap.

* * * * *